US010876283B2

(12) United States Patent
Ledoux et al.

(10) Patent No.: US 10,876,283 B2
(45) Date of Patent: Dec. 29, 2020

(54) SELF-STORAGE FACILITY, FABRICATION, AND METHODOLOGY

(71) Applicant: STORAGE IP LLC, Houston, TX (US)

(72) Inventors: David Wayne Ledoux, Houston, TX (US); Richard Waldon Stockton, Jr., Houston, TX (US)

(73) Assignee: STORAGE IP LLC, Houston, TX (US)

( * ) Notice: Subject to any disclaimer, the term of this patent is extended or adjusted under 35 U.S.C. 154(b) by 0 days.

(21) Appl. No.: 16/368,837

(22) Filed: Mar. 28, 2019

(65) Prior Publication Data

US 2019/0226199 A1 Jul. 25, 2019

Related U.S. Application Data

(63) Continuation of application No. 15/565,134, filed as application No. PCT/US2016/026406 on Apr. 7, 2016, now Pat. No. 10,280,608.

(60) Provisional application No. 62/144,284, filed on Apr. 7, 2015.

(51) Int. Cl.

| | |
|---|---|
| ***E04B 1/34*** | (2006.01) |
| ***E04B 1/348*** | (2006.01) |
| ***B65D 88/02*** | (2006.01) |
| ***B65D 90/00*** | (2006.01) |

(52) U.S. Cl.

CPC ..... *E04B 1/3483* (2013.01); *B65D 88/022* (2013.01); *B65D 90/0006* (2013.01); *E04B 2001/34892* (2013.01)

(58) Field of Classification Search

CPC . B65D 88/022; B65D 90/0006; E04B 1/3483; E04B 2001/34892

See application file for complete search history.

(56) References Cited

U.S. PATENT DOCUMENTS

| | | | | |
|---|---|---|---|---|
| 3,748,793 | A * | 7/1973 | Tompkins | E05D 15/0613 52/64 |
| 3,792,558 | A * | 2/1974 | Berce | E04B 1/348 52/79.7 |
| 3,925,679 | A * | 12/1975 | Berman | E04B 1/3483 290/1 R |
| 4,599,829 | A * | 7/1986 | DiMartino, Sr. | E04B 1/3483 410/79 |
| 4,950,114 | A * | 8/1990 | Borchardt | B65D 88/022 24/287 |
| 5,167,575 | A * | 12/1992 | MacDonald | E04B 2/827 454/187 |
| 7,827,738 | B2 * | 11/2010 | Abrams | E04B 1/003 52/79.1 |
| 8,769,886 | B2 * | 7/2014 | Ohnishi | E04B 1/3483 52/125.2 |
| 8,833,001 | B2 * | 9/2014 | Gardner | E04B 1/34384 52/64 |

(Continued)

FOREIGN PATENT DOCUMENTS

| | | | | |
|---|---|---|---|---|
| FR | 2441703 | A1 * | 6/1980 | E04H 5/06 |

*Primary Examiner* — Adriana Figueroa

(74) *Attorney, Agent, or Firm* — Carrington, Coleman, Sloman & Blumenthal, L.L.P.

(57) ABSTRACT

A self-storage facility. The facility comprises a first set of commercial containers forming a first level of storage volume and a second set of commercial containers, atop the first set, forming a second level of storage volume.

16 Claims, 11 Drawing Sheets

(56) References Cited

U.S. PATENT DOCUMENTS

| | | | | |
|---|---|---|---|---|
| 8,991,134 | B2 * | 3/2015 | Wheeler | E04B 1/343 220/1.5 |
| 9,631,359 | B2 * | 4/2017 | Malakauskas | E04B 1/34838 |
| 9,663,962 | B1 | 5/2017 | Whittemore | |
| 2005/0055891 | A1 * | 3/2005 | Kuebler | E04B 1/3431 52/79.1 |
| 2007/0271857 | A1 * | 11/2007 | Heather | B65D 88/005 52/79.9 |
| 2009/0031642 | A1 * | 2/2009 | Donovan | E04B 1/3444 52/79.1 |
| 2009/0101446 | A1 | 4/2009 | Franchi | |
| 2010/0024353 | A1 * | 2/2010 | Pope | E04B 1/3431 52/745.02 |
| 2011/0011314 | A1 | 1/2011 | Slagel et al. | |
| 2011/0056147 | A1 * | 3/2011 | Beaudet | E04B 1/3483 52/79.9 |
| 2011/0146751 | A1 | 6/2011 | McGuire et al. | |
| 2011/0173907 | A1 * | 7/2011 | Katsalidis | E04B 1/3483 52/236.3 |
| 2014/0115976 | A1 | 5/2014 | Lippert | |
| 2016/0168844 | A1 * | 6/2016 | Lago De Carvalho | E04B 1/3483 52/79.5 |
| 2016/0222649 | A1 * | 8/2016 | Baik | E04H 1/005 |

* cited by examiner

SELF-STORAGE FACILITY, FABRICATION, AND METHODOLOGY

TECHNICAL FIELD

The preferred embodiments relate to self-storage facilities.

BACKGROUND ART

Self-storage facilities are prolific and include a number of associated storage units located at a single location, which may be indoor, outdoor, or a combination thereof and also may or may not include climate control. A typical facility rents or leases individual storage units, which may vary in size, configuration, and are often priced accordingly. The owner/lessee of a unit is then able to store and retrieve various items within their unit and access them over typically flexible times during the period of the agreement, subject to any additional limitations of the agreement.

While the above is well-established and has served both facility owners and users, existing single level and multi-level self-storage facilities can be expensive to design, build, and climate-control. The present inventors have recognized these drawbacks as well as others and, the preferred embodiments, therefore, seek to improve upon the prior art. Such preferred embodiments are further explored below.

DISCLOSURE OF INVENTION

In one preferred embodiment, there is a self-storage facility. The facility comprises a first set of commercial containers atop a substrate forming a first level of storage volume; and a second set of commercial containers, atop the first set, forming a second level of storage volume, wherein a top of at least one commercial container in the first set provides support for a walking surface for accessing an interior of at least one commercial container in the second set.

Other aspects are described and claimed.

BRIEF DESCRIPTION OF DRAWINGS

The preferred embodiments are described in detail below by referring to the accompanying drawings.

DESCRIPTION OF EMBODIMENTS

The preferred embodiments place and stack shipping containers in a self-storage facility with various advantages, including the elimination of the need for building additional infrastructure to support multiple floors or levels in a self-storage building.

Figure 1:
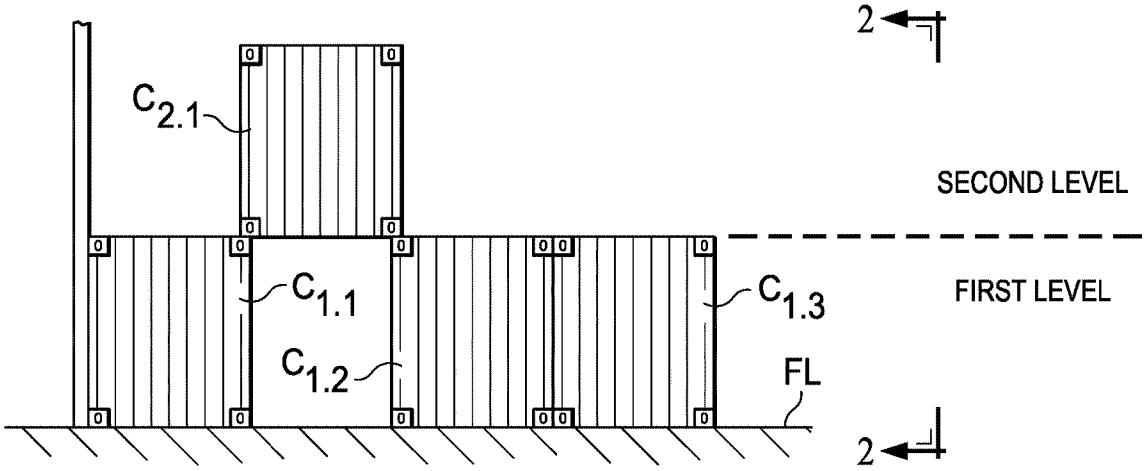
FIG. 1 illustrates a diagrammatic block diagram end and cross-sectional view of shipping containers arranged to serve as storage units in a storage facility.
Figure 2:
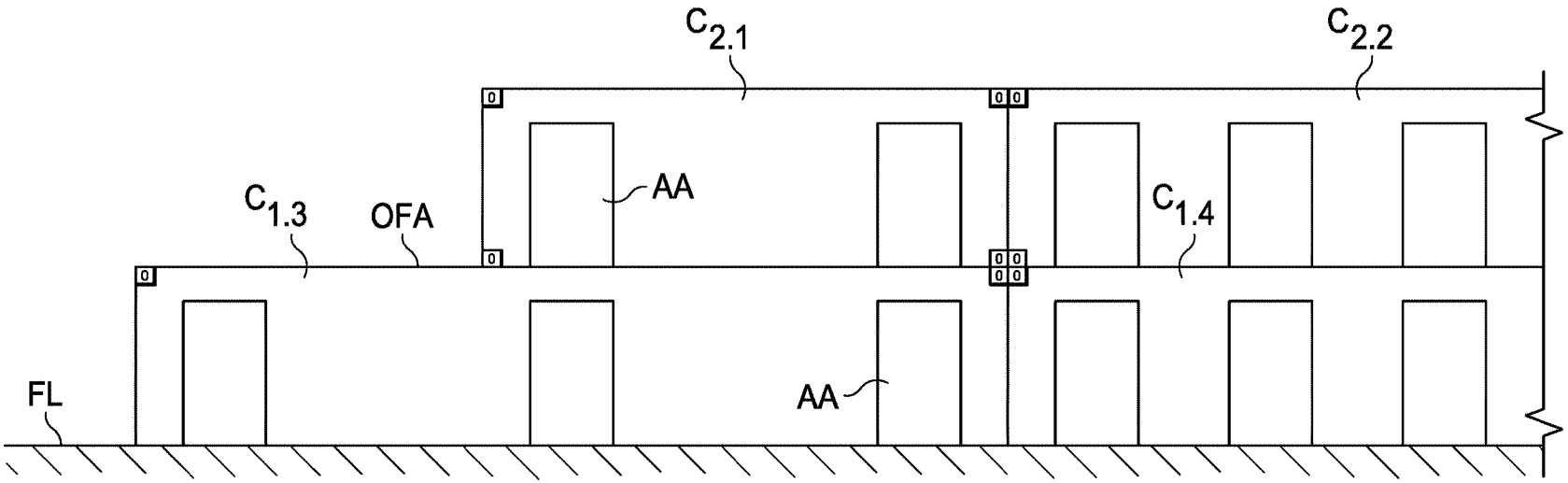
FIG. 2 illustrates a side view of the illustration of FIG. 1.

The preferred embodiments combine existing commodities, namely, standard steel shipping or intermodal containers or the like (the "Container" or "Containers"), with an existing building structure or in an open area, and contemplate various arrangement and supplemental apparatus, in a novel and inventive manner Containers are typically manufactured from metal and used to transport goods by truck and shipping vessel. In the preferred embodiment, however, the Containers are stacked either on a substrate (e.g., floor FL) or on top of and/or beside each other, as shown in FIGS. 1 and 2. Specifically, FIG. 1 illustrates an end view, and FIG. 2 a side view, of various Containers $C_{1.1}$ through $C_{1.4}$ on a First Level where each such Container is atop the floor FL, with second Containers $C_{2.1}$ and $C_{2.2}$ on the Second Level, thereby contacting and supported beneath by First Level Containers. In this regard, the existing outer structure of the individual Containers provide a general framework, and then additional preferred embodiment modifications are implemented so as to accommodate myriad possible storage sizes and configurations.

For example, a typical Container is on the order of 8×40 feet, so a number N1 of containers may be positioned side-by-side along a same horizontal plane (e.g., a First Level floor), thereby providing a total volume of 8×40×N1 square feet of storage, albeit with the Container walls segregating each Container interior from the other. The preferred embodiments, however, contemplate selectively removing portions of such walls, as well as adding interior partitions or walls, so that in this example the 8×40×N1 cubic feet is readily re-partitioned into different units of different sizes. As shown in FIG. 2, such as either Containers $C_{1.3}$ and $C_{1.4}$ on the First Level, or Containers $C_{2.1}$ and $C_{2.2}$ on the second Level, a number N2 (e.g., N2=2) of Containers may be positioned in a single line, thereby providing exterior walls and a ceiling that are 8×(40×N2) feet, and further permitting the addition of walls or other partitions inside the Containers so that an individual Container, nominally 8×40 on its exterior, may on its inside provide a number of segregated storage units. Also as shown later, some units may be aligned so that their major axis, that is, the axis along the longer dimension of the Container (i.e., the length) are parallel in side-by-side fashion or co-linear along a continuous line of two or more Containers, while others (e.g., see, FIG. 4) have their major axis in a different (e.g., perpendicular) orientation to other Containers. Thus, while not shown in FIG. 2, with Containers stacked on the First Level atop the floor FL, a Second Level of Containers are positioned atop the First Level Containers, with the positioning of the Second Level Containers being that the major axis of the Second Level Containers can be either in the same direction or perpendicular with respect to one another as well as with respect to the First Level Containers. The Containers can be set adjacent to a wall (See FIG. 1, Container $C_{1.1}$) and/or configured in such a way as to provide fall protection (see e.g., FIG. 4) around the perimeter of the Second Level, that is, by allowing access only from the area that is within the outer perimeter of the overall configuration of Containers, so that the structure of the perimeter Containers also provide a barrier to falling or the like. Finally, while these and other Figures illustrate two Levels, the preferred embodiments further contemplate multiple levels beyond just two Levels.

As shown in other Figures, each Container is provided with one or more access apertures AA, some of which are labeled by way of example in FIG. 2, as may be a slidable door or the like, with the frame of the Container cut away so as to provide the aperture and appropriate hardware added so as to allow the aperture to be open and closed by a user (e.g., a movable door, member, or the like). Thus, such access doors or the like, installed in the arranged Containers, provide access to property stored therein.

Also in the preferred embodiments, certain Containers may be positioned so that the top of one Container provides a floor area in front of the access apertures of a Container above it. For example, in FIG. 2, an open floor area OFA is shown to the left of the leftmost end of Container $C_{2.1}$, eliminating the requirement of additional structural build-out to support the weight of the upper levels or floors. Because Containers comply with standard dimensions, and given the teachings of this document, one skilled in the art may readily find manners, potentially with or without additional apparatus, so as stack, install, and orient the Containers, providing a short construction or installation period, as compared to that required in traditional self-storage facilities. Moreover, note that while not shown in FIG. 2, an additional Container may be to the left of the open floor area OFA and perpendicular to the Containers in FIG. 2, so as to define a perimeter wall above and along the far left end of Container $C_{1.3}$.

Further in a preferred embodiment, the Containers are installed in either a climate controlled environment, a covered non-climate controlled environment, outside, or a combination of two or three of these locations.

It is to be observed that various benefits are achieved by the preferred embodiment use of common commodity Containers. Their dimensions and load carrying capacities are controlled and uniform, providing a dependable, predictable, and stackable means of providing single-level or multi-level self-storage volume and facilities. Moreover, the Containers may be obtained already fitted, or be retrofitted, with multiple doors or other manners of access, with each container providing several individual self-storage units. Because of the preferred embodiment unique design and layout of the Containers, access to storage units are a combination of:

- The entire volume of a Container, or
- A partial volume of a Container (when walls are installed inside the Container), or
- A partial volume of several side-by-side Containers. For example if two 40 foot containers are situated side-by-side lengthwise, one storage unit could be the first 8' section of both Containers, accomplished by cutting out the walls of both units to allow access. (See FIG. 1, position 1 and 2)

Further in a preferred embodiment, access to Containers located above the First Level (i.e., ground) is provided by an elevator (lift), stairs, ladder, or combination thereof.

Further in a preferred embodiment, the Containers on a lower Level provide all, or a majority of, the floor walking access or area to the Containers on the Level(s) above (see FIGS. 1 and 2, Containers $C_{1.1}$ through $C_{1.4}$), with perhaps the exception of the elevator or stair landing(s).

In all events, from the above, the preferred embodiments provide an improved self-storage facility, fabrication, and methodology. Such embodiments, therefore, may provide numerous advantages over the prior art, particularly since such existing single level and multi-level self-storage facilities can be expensive to design, build, and climate-control. In contrast, the preferred embodiments provide:

- Quick, cost effective construction that can be completed in about half the time of brick and mortar construction and for a significant reduction in cost.
- The Containers are not attached to a floor, wall or ceiling, so they are not a part of real property and can be moved or relocated if desired.
- Does not require any structural build-out typical of multi-level construction such as structural beams, concrete, additional steel supports or any other structural build-out required to hold the weight of additional levels.
- Structural integrity of the Containers on lower Levels provide safe multi-story walkways on upper levels, and likewise the containers on an upper level above provide ceilings or covered walkways for accessing the containers on the level below.
- The specific configuration of the Containers can be changed to adapt to any specific building dimension.
- This invention significantly increases the number of self-storage units per square foot of space because of the utilization of the self-storage Containers as floors and ceilings. A typically constructed multi-level self-storage facility does not have rentable space above a first level hallway or below a second level floor. The preferred embodiments allow for this maximizing the rentable square footage available.

Figure 3:
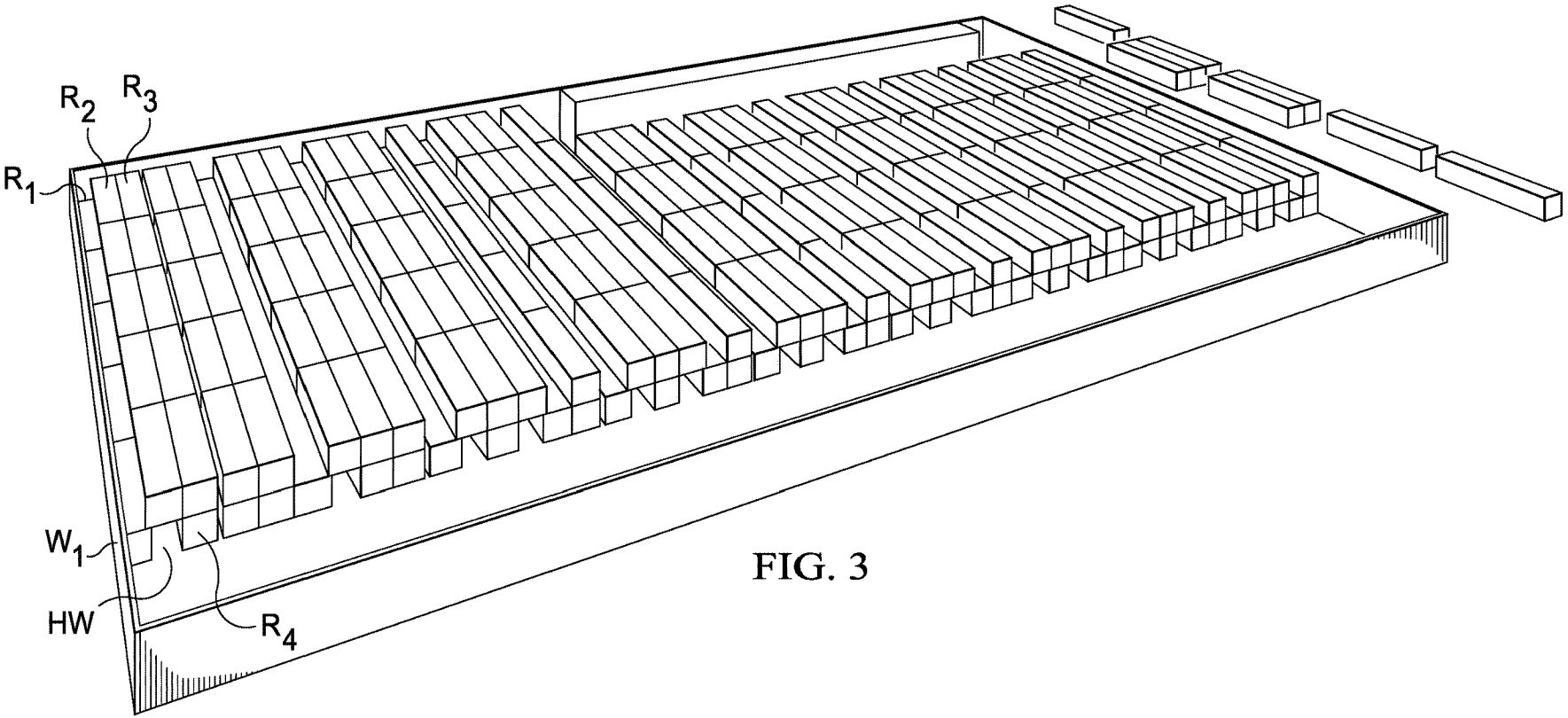
FIG. 3 illustrates a perspective view of a plurality of shipping containers arranged with a respective major axis parallel to the major axis of other shipping containers, creating both first and second floor storage in the facility.

FIG. 3 illustrates a perspective view of a plurality of shipping Containers arranged in both first and second Level storage in a facility. In the FIG. 3 arrangement, each of the Containers has its major axis along a same dimension parallel to the major axis of the other Containers. Thus, a first row $R_1$ with four First Level Containers is shown to the left of the Figure and abutting a wall $W_1$ of the facility; thus, the top of the Containers in row $R_1$ provide a walkway that has a perimeter to prevent falling by wall $W_1$ on the left, and to the right of that walkway are four Second Level Containers in a row $R_2$, where the row $R_2$ Containers are supported in the Second Level in manners described later. In any event, provided apertures are formed on the left side of the row $R_2$ Containers, then a person walking on the walkway atop the row $R_1$ Containers has access to the inside of the row $R_2$ Containers. To the right of the Second Level row $R_2$ containers are, in the same Second Level, a row $R_3$ of Containers, and below the row $R_3$ of Containers is a row $R_4$ of Containers. Note, therefore, that in the First Level, between rows $R_1$ and $R_4$, there is an opening that run along the axes of the Containers but that is generally not occupied by a Container; this opening, therefore, provides a hallway HW between Containers in rows $R_1$ and $R_4$. Moreover, the Containers in row $R_2$ provide a roof over the hallway HW. In all events, therefore, FIG. 3 thereby illustrates numerous hallways in both the First Level and Second Level, where a Container is not present but there is a Container positioned both the left and right of the hallway (and above it, for the First Level hallways).

Figure 4:
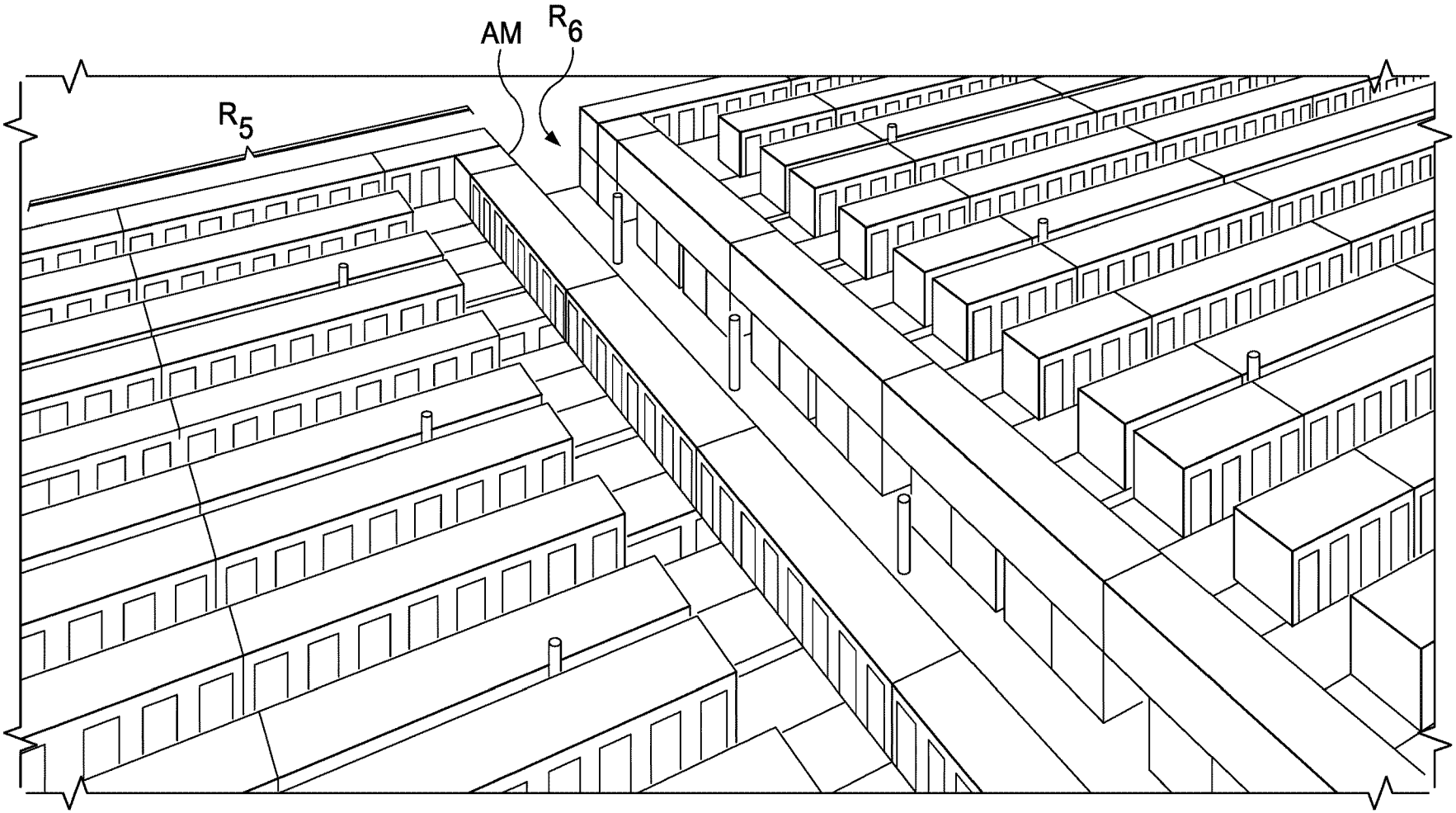
FIG. 4 illustrates a perspective view of a plurality of shipping Containers, a majority of which are arranged with a respective major axis parallel to the major axis of other shipping containers, creating both First and Second Level storage in the facility, with the additional of a number of Second Level Containers oriented perpendicularly around a perimeter of a group of First Level containers.

FIG. 4 illustrates a perspective view of a plurality of shipping Containers, a majority of which are arranged with a respective major axis parallel to the major axis of other shipping containers, creating both First and Second Level storage in the facility, with the additional of a number of Second Level Containers oriented perpendicularly around a perimeter of a group of First Level Containers. By way of example, therefore, to the back left of FIG. 4 is a first row $R_5$ of Second Level Containers with respective co-linear major axes, below which are additional supporting Containers that are not visible from the perspective view. Indeed, the majority of the Containers depicted in FIG. 4 also have respective major axes aligned parallel to the axes of row $R_5$. In contrast, however, FIG. 4 also includes a row $R_6$ of Containers, where within that row the major axis of each Container is co-linear with that of the other Containers in the row, but the orientation of that co-linear row is perpendicular to that of the many rows oriented generally left-to-right in the Figure. In addition, an elevator or stairway access mechanism AM is also shown so that row $R_6$ may be accessed from below. Further in this regard, the Containers in row $R_6$ may have their endwalls removed (or a portion thereof), creating a Second Level hallway access to the tops of any First Level Container, so as to walk thereupon and access a Second Level Container.

Figure 5:
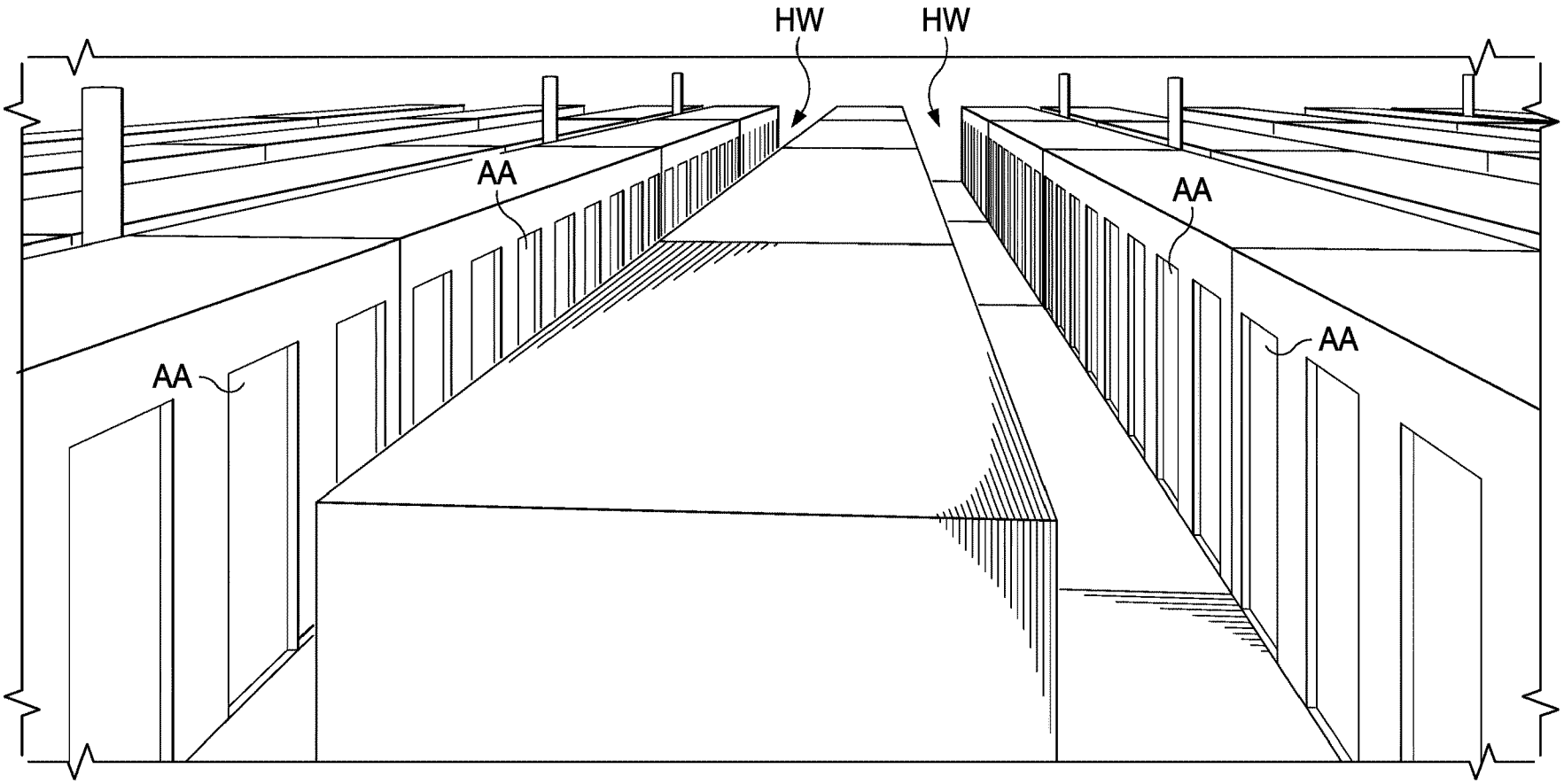
FIG. 5 illustrates an enlarged partial view of FIG. 4, with a perspective that illustrates how the tops of First Level Containers provide a floor for walking/access to Second Level Containers.

FIG. 5 illustrates an enlarged partial view of FIG. 4, with a perspective that illustrates how the tops of First Level Containers provide a floor for walking/access to Second Level Containers. Thus, Second Level hallways HY are shown, where a person walking along such a hallway is supported by the top of an underlying First Level Container, and to the left and right of each Hallway is a Second Level row of axially co-aligned Containers. Also in this perspective, numerous access apertures AA are illustrated to depict respective entrances to storage unit areas formed within each Container, and walled apart from one another as detailed later.

Figure 6:
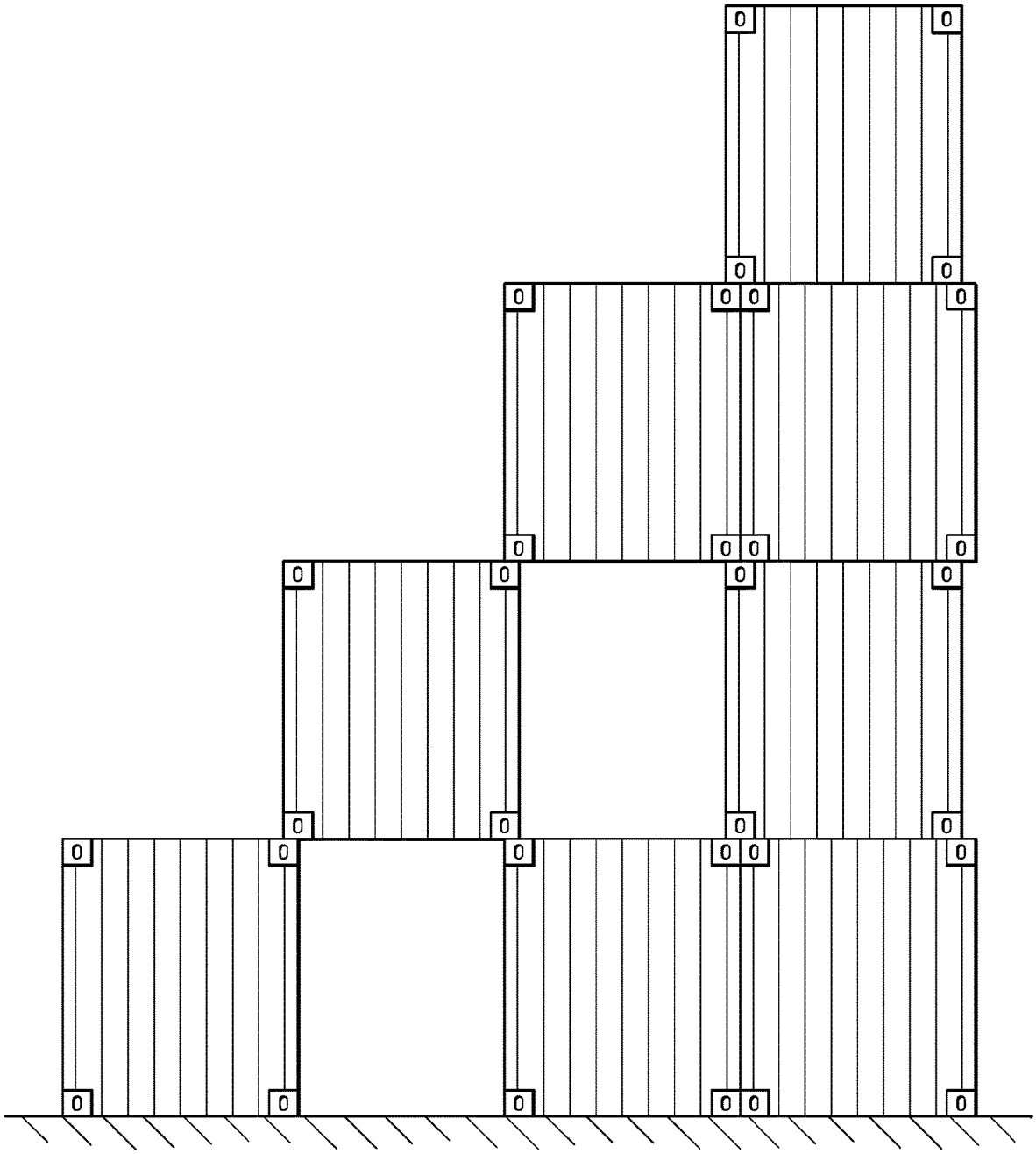
FIG. 6 illustrates an end view of a plurality of Containers stacked in an offset manner as between successive Levels.

FIG. 6 illustrates an end view of a plurality of Containers stacked in a manner to create walk ways (i.e., hallways), whereby either the ground under the first level of containers provides a floor or the upper surface of a Container on the first or higher level likewise provides a floor, and where the upper surface a Container at a level above the first level provides a ceiling for the Container itself and its lower surface may provide a ceiling to a level below it. Thus, the Containers are positioned to provide floors, roofs, and access to the space inside the Containers on either side of a hallway. In the preferred embodiment, corner castings are integral to the Containers and are preferably the only components of a Containers that touches one or more other Containers. It is standard in the shipping container industry for the corner castings of stacked Containers to rest on atop the other, without any offset. When used for intermodal transport, Containers stacked atop other shipping containers impose very high loads on the lowest elevation Containers. However, in the preferred embodiment, the items stored in a Container are intended to be significantly less in weight than the intended original design of the Container for shipping, so in effect more or less empty Containers will be used to construct a building or volumetric arrangement, which can be used as a storage facility or other purpose. The loaded weight of the stacked shipping Containers used to construct the building will be much less than the loaded weight of Containers used for intermodal transport. As a result, the preferred embodiments contemplate that loading on the corner castings will be less demanding; further in this regard, therefore, and consistent with creating the hallway, floor, and ceiling arrangement described herein, in a preferred embodiment, the method of stacking Containers allows Containers with a parallel major axis, one above the other, to be stacked with a slight offset so that the respective axes are not directly above one another. For example, as shown on the bottom two levels in FIG. 6, note with respect to a first Container shown to the far right on the first level of FIG. 6, a second Container, immediately above the first Container, is shifted a distance W/2 to the left, relative to that far right first level Container. In the preferred embodiment, W is the width of the Container corner casting, so therefore the second Container is shifted ½ of that width to the left. On the same second level, therefore, a walk way is created by no shipping container immediately to the left of the second Container, so the left wall of the second Container provides the right wall to that walkway; additionally, however, a third Container, shown as the other Container on the second level, is shifted W/2 to the right, relative to first level Container below it, so that the right wall of that third Container provides a left wall to the second level hallway. Moreover, above that walkway, on the third level, is shown an additional fourth Container that is shifted W/2 to the left relative to the second Container on the second level and shifted W/2 to the right relative to the third Container on the second level, so that the bottom of the fourth Container provides the ceiling to the hallway, while of course the fourth Container also provides a storage volume. Thus, for numerous configurations, each corner casting will not be placed directly atop the lower shipping container's corner casting. Instead, the lower casting will rest atop the upper casting of a lower Container, with the overlap being one half the width of the castings.

Figure 7A:
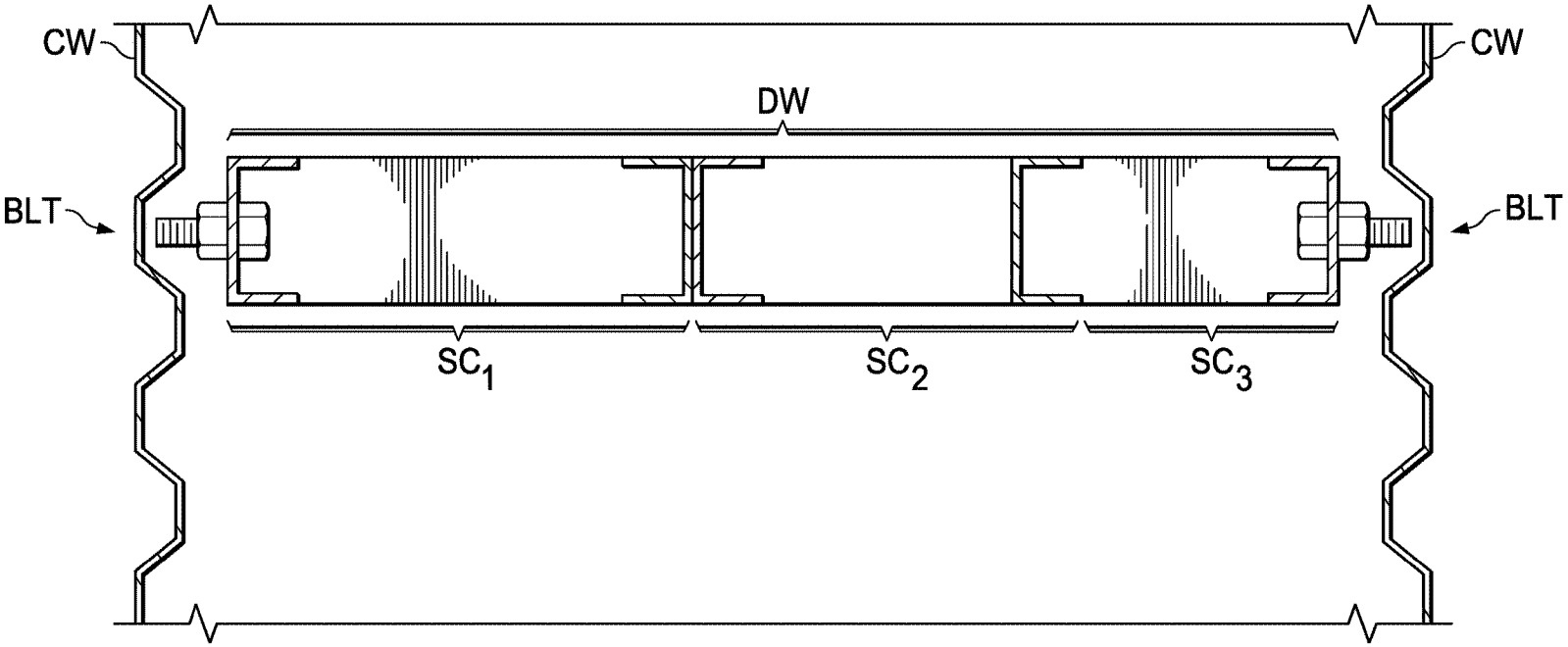
FIGS. 7A and 7B illustrates views of a dividing wall that may be added to the inside of a Container according to a preferred embodiment.
Figure 7B:
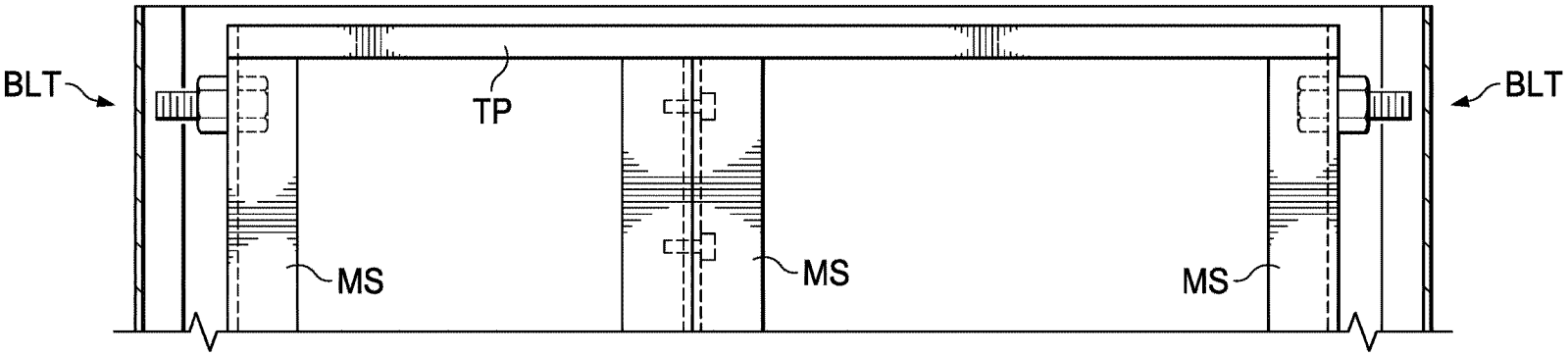

FIG. 7A illustrates a top view, and FIG. 7B a side view, of a dividing wall DW that may be added to the inside of a Container and between the corrugated walls CW of the Container, according to a preferred embodiment. The dividing wall DW is preferably manufactured in a plurality (i.e., two or more) of sections shown as $SC_1$, $SC_2$, and $SC_3$, and is designed to be easily moved. Preferably, each dividing wall DW is constructed of commercial metal studs MS, top plates (see TP, FIG. 7B), and bottom plates. Each section can be skinned on one or more sides with siding materials, attached to the studs and top/bottom plates. The wall sections are attached to each other in a co-planar fashion, forming the entire wall. In a preferred embodiment, the wall is held in place via commercially available threaded bolts and nuts.

Further in the preferred embodiment, at the ends of an assembled walls, a threaded bolt BLT (or plural bolts) are positioned through an end plate or stud at the end of the wall so that the end of the bolt is directed toward the inside of a Container wall, and a bolt is threaded onto the opposing end of the bolt (i.e., on the Container wall side of the metal stud). A wrench is used to prevent the nut from turning, while another wrench is used to turn the bolt so that the bolt tip advances toward, and abuts with, the inside of the Container wall. Typically, Container walls CW are corrugated, so preferably the above structure and methodology are effected so that the bolt tip will abut the farthest outside width of the Container wall, that is, within the ridges created by the corrugation along the Container wall; in this manner, not only will the abutment of the bolt tip maintain the dividing wall in place relative to the Container wall, but the ridges of the Container corrugated wall further reduce the chance of lateral movement of the dividing wall. Moreover, the above is repeated structurally and methodically so that at all bolts secure a dividing wall to the Container wall and can be used to create multiple divided spaces within a single Container, while still allowing the dividing wall to be easily moved to any location in the Container; loosen the bolts, reposition the wall, and compress the bolts against the Container wall.

Figure 8A:
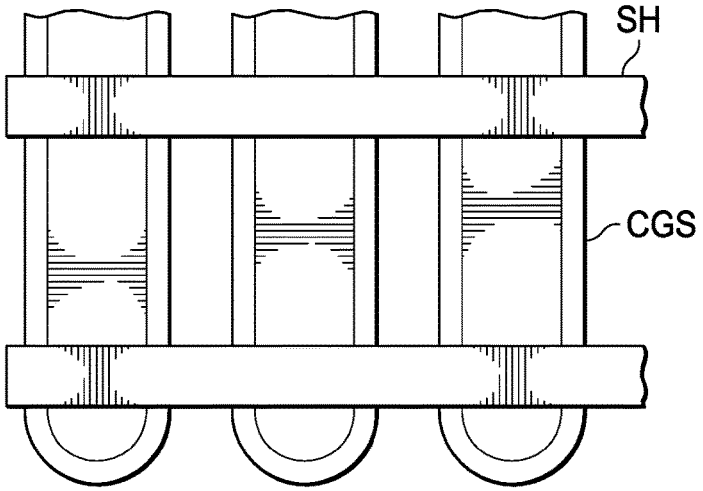
FIG. 8A illustrates a top view, and FIG. 8B a side view, of a preferred embodiment floor panel located atop the corrugated roof of a Container.
Figure 8B:
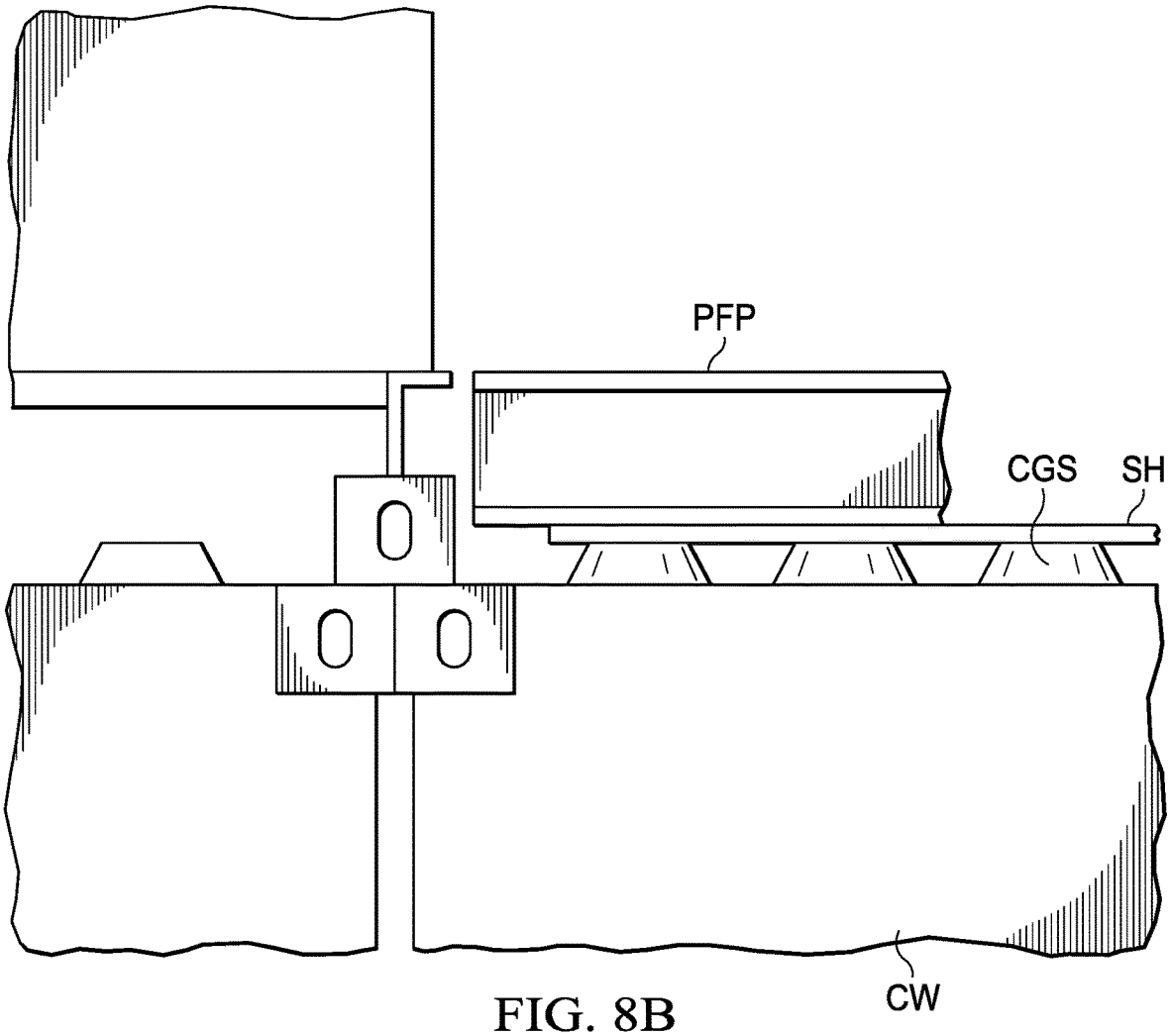

FIG. 8A illustrates a top view, and FIG. 8B a side view, of a preferred embodiment floor panel located atop the corrugated roof of a Container. Specifically, the preferred embodiments recognize that typical Containers as commercially available and described herein include not only corrugation in the walls, but also a corrugated surface CGS along the top of the Container. Since the preferred embodiments contemplate using the top of a shipping Container to define the bottom of a hallway located above that Container, then further included are apparatus for accommodating the corrugated surface CGS to make it safer and more usable as a walking surface. In this regard, FIG. 8B illustrates that a structural planar floor panel PFP surface is preferably positioned atop a Container (and may be separated therefrom with shims SH as shown, if needed), when the top of that Container provides a weight bearing surface for a walkway above that Container. Thus, the preferred embodiment floor panel provides a walking surface at the same elevation as the floor in a neighboring shipping Container.

Figure 9:
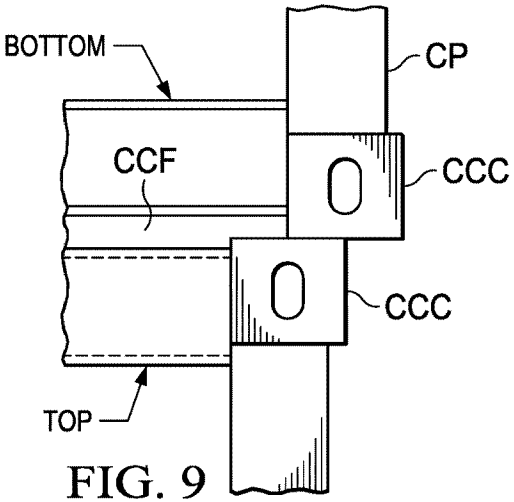
FIG. 9 illustrates a side view of a partial view of two Containers, stacked atop the other according to the preferred embodiments, with a foam or other gasket between the Containers.

FIG. 9 illustrates a side view of a partial view of two Containers, stacked atop the other according to the preferred embodiments. It is observed in connection with the present inventive scope, however, that when such Containers are stacked, a gap exists between the Containers. In the prior art, such gaps may be acceptable, given the nature of the Containers for shipping goods, or given that only the interior volume of the Container is at issue for purposes of environmental protection. In the preferred embodiments, however, inasmuch as a Container may provide a wall, floor, or ceiling, to an adjacent area, then preferably additional structure is included so as to limit rain or other environmental intrusion as between adjacent or stacked Containers. In one preferred embodiment, therefore, a water-tight seal is created between the Containers by applying an expanding closed cell foam CCF in the horizontal gap between the top of one Container in a first Level and the bottom of the Container in the next upper Level. Thus, in the illustrated perspective the top of the lower Level Container is shown and has a container corner casting at its end, which supports above it the container corner casting of the upper Level Container above the lower Level Container (where the two corner castings are offset in this example, as discussed above). Thus, a gap exists between the Top of the lower Level Container and the Bottom of the upper Level Container, and a closed cell foam CCF is shown in the gap. In an alternative preferred embodiment, an oversized closed cell gasket is positioned in the gap. Note further in this regard that such approaches are preferably more adaptable as between the horizontal surfaces of the Containers, such as atop a bottom Container before positioning an upper Container above that bottom Container.

Figure 10B:
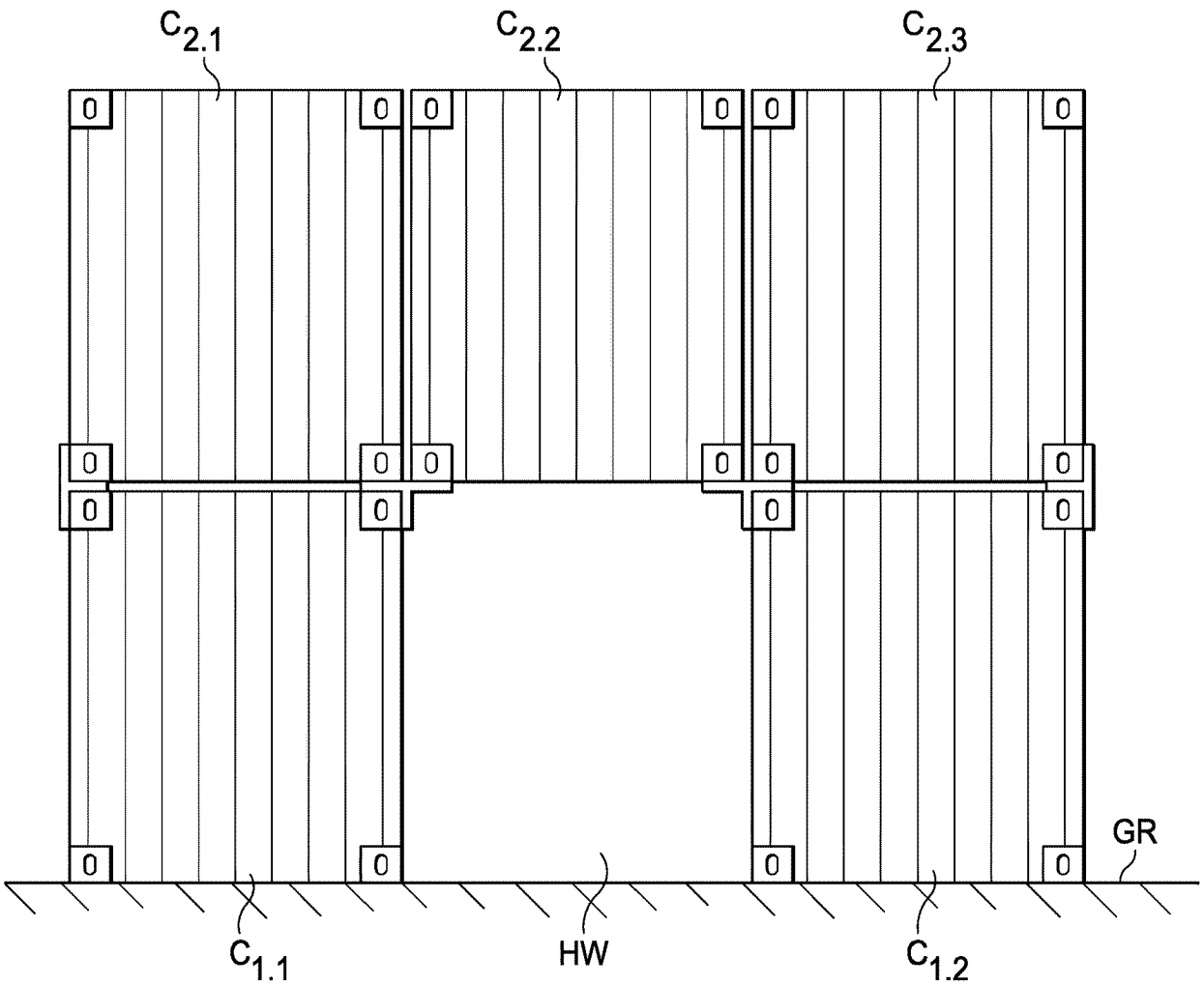
FIGS. 10A through 10C illustrates a preferred embodiment apparatus for supporting an upper Level Container without the need for support from a lower Level Container directly beneath the upper Level Container.
Figure 10A:
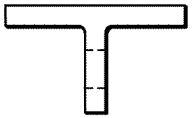
Figure 10C:
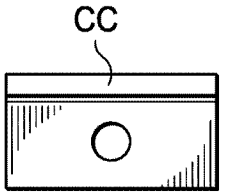

FIGS. 10A through 10C illustrates a preferred embodiment apparatus for supporting an upper Level Container without the need for support from a lower Level Container directly beneath the upper Level Container. Specifically, as shown in end view in FIG. 10A and in smaller end view in various locations in FIG. 10B, a "T" shaped steel member, as is commercially available for other application, is obtained and is approximately the same length as the Container corner castings CC. The T-member is affixed (e.g., bolted) to the top corner castings CC (see FIGS. 10B, 10C) of the lower Level Container. In this configuration and as shown, approximately a first half of the horizontal portion of the T can therefore support a Container immediately above the Container to which the T-member is attached, while approximately a second half of the horizontal portion of the T can therefore support a Container immediately and to the left or right of Container to which the T-member is attached. Thus, the alternative preferred embodiment of FIGS. 10A-C eliminates the preferred embodiment approach described above for shifting different-level Containers a distance of W/2 relative to one another. Moreover, removing the need for a bottom supporting Container creates a hallway HW to access the space inside the shipping containers on either side of the hallway. This is shown by way of example in FIG. 10B, whereby a hallway HW is provided between lower level Containers $C_{1.1}$ and $C_{1.2}$, where above the hallway HW is supported a Container $C_{2.2}$, supported by the respective T-members of Containers $C_{1.1}$ and $C_{1.2}$.

Figure 11A:
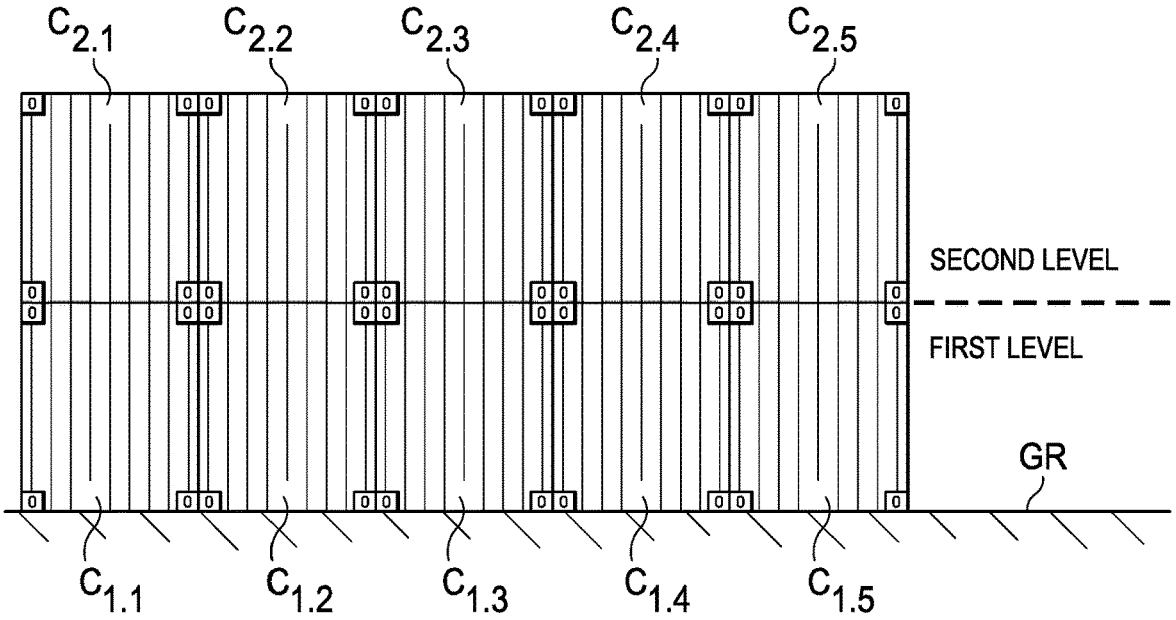
FIGS. 11A and 11B illustrate respective end and top views of an alternative preferred embodiment for forming self-storage units (SSU) and hallways (HW) by stacking a number of Containers with the vertical walls of a Container in one level aligned with the vertical walls of a Container in a next higher level.
Figure 11B:
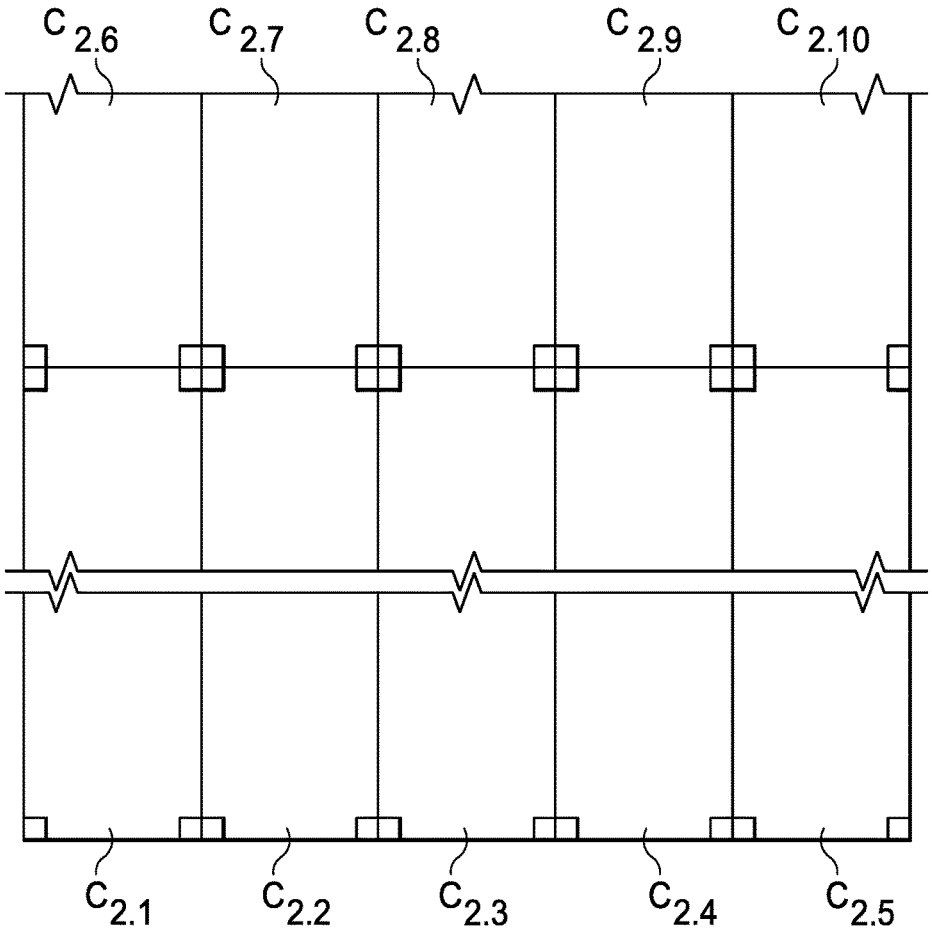

FIGS. 11A and 11B illustrate respective end and top views of an alternative preferred embodiment for forming self-storage units (SSU) and hallways (HW) by stacking a number of Containers with the vertical walls of a Container in one level aligned with the vertical walls of a Container in a next higher level. As shown in FIG. 11A, therefore, a First Level of Containers is shown to include five Containers $C_{1.1}$ through $C_{1.5}$ atop a grade GR (such as the ground). Similarly, a Second Level of Containers is shown to include five Containers $C_{2.1}$ through $C_{2.5}$. Each Second Level Container has its vertical walls aligned in the same vertical plane as the First Level Container beneath it. Thus, in contrast to earlier preferred embodiment wherein the corner castings of one level are vertically offset with respect to respective corner castings of a next atop level, in FIG. 11A the top corner castings of the First Level Containers are vertically aligned with the bottom corner castings of the Second Level Containers. Moreover, while FIG. 11A illustrates only two Levels of Container stacking, multiple additional levels may be added, such as up to five Levels or higher.

With the arrangement of FIGS. 11A and 11B, any Containers on a same Level and with their major axis aligned may be used to form either hallways HW or self-storage units (SSU), where to form a hallway HW at least a majority portion of the endwalls and a portion of the sidewalls of the selected Containers along the hallway are removed (e.g., by cutting). For example, in the top view of FIG. 11B, Second Level Containers $C_{2.1}$ through $C_{2.5}$ are again shown, adjacent a second set of Second Level Containers $C_{2.6}$ through $C_{2.10}$. In this example, however, Containers $C_{2.3}$ and $C_{2.8}$ have their major axes aligned (i.e., along the major length of each Container), and it is desired to form a hallway HW along those axes. Accordingly, where Container $C_{2.3}$ adjacent Container $C_{2.8}$, a majority of the respective ends of each such Container in that vicinity are cut away, there forming a passage between what was the interior of Containers $C_{2.3}$ and Container $C_{2.8}$. Moreover, a portion of the side walls of Containers $C_2$. and Container $C_{2.8}$ are also cut away, thereby providing access to each Container to the left or right of the hallway Containers $C_{2.3}$ and $C_{2.8}$—thus, the sidewall cutaways of Container $C_{2.3}$ provide access from the interior of Container $C_{2.3}$ to either Container $C_{2.2}$ or Container $C_{2.4}$, and the sidewall cutaways of Container $C_{2.8}$ provide access from the interior of Container $C_{2.8}$ to either Container $C_{2.7}$ or Container $C_{2.9}$. Hence, Containers $C_{2.3}$ and $C_{2.8}$ form a hallway HW, while Containers to the sides of that hallway (i.e., Containers $C_{2.2}$, $C_{2.4}$, $C_{2.7}$, and $C_{2.9}$) remain as self-storage units SSU.

Figure 12A:
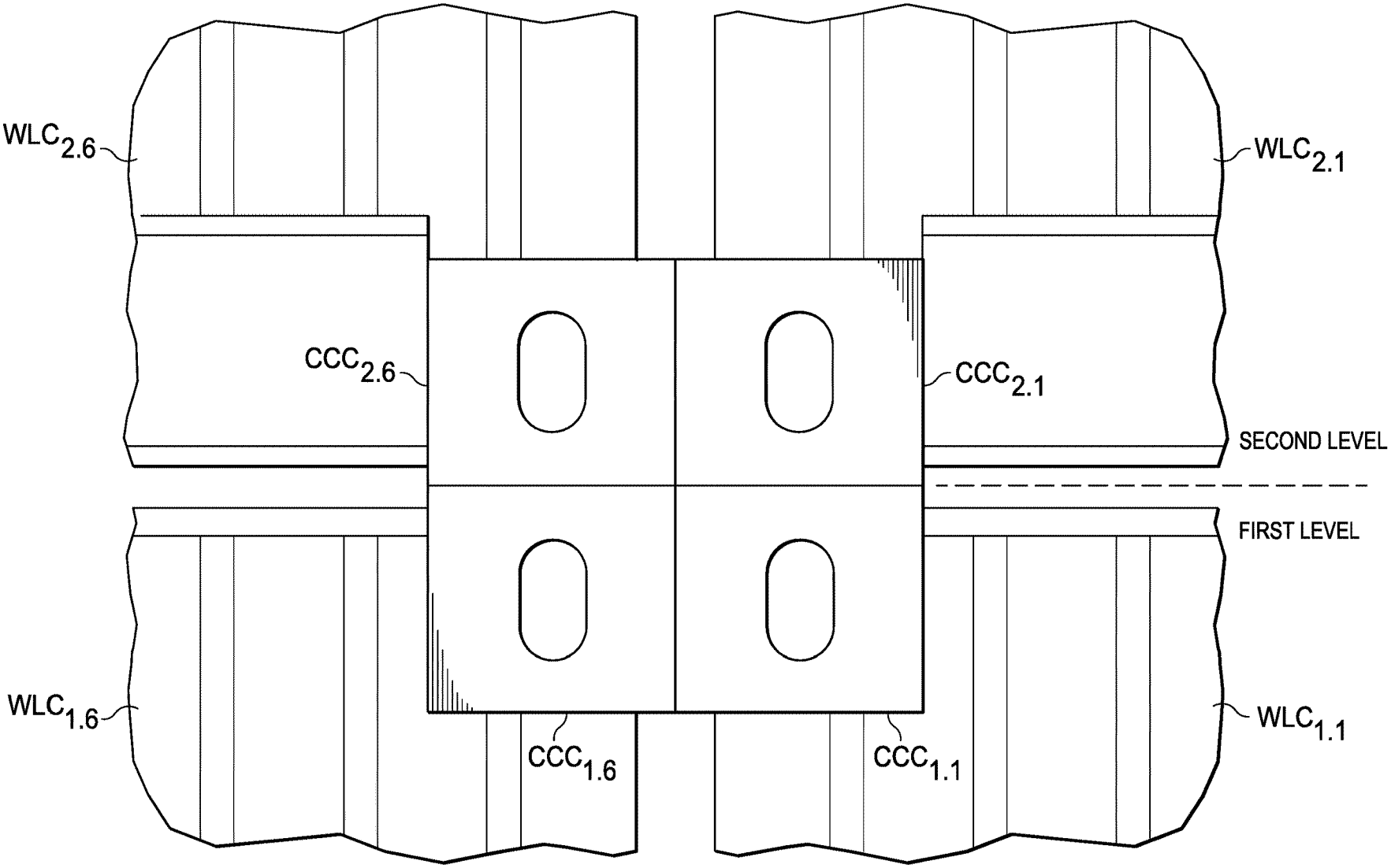
FIGS. 12A, 12B, and 12C illustrate a preferred embodiment structure for affixing Containers together when aligning Container vertical walls as shown in FIGS. 11A and 11B.
Figure 12B:
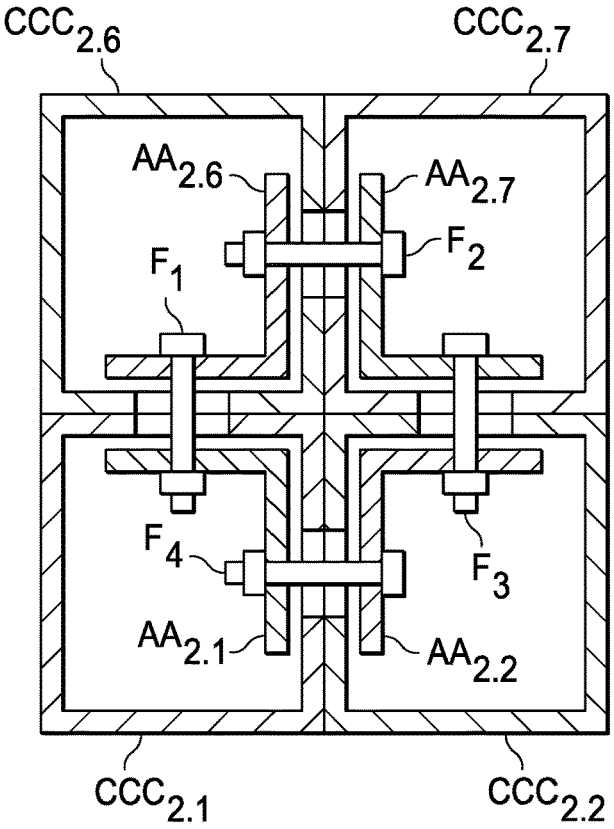
Figure 12C:
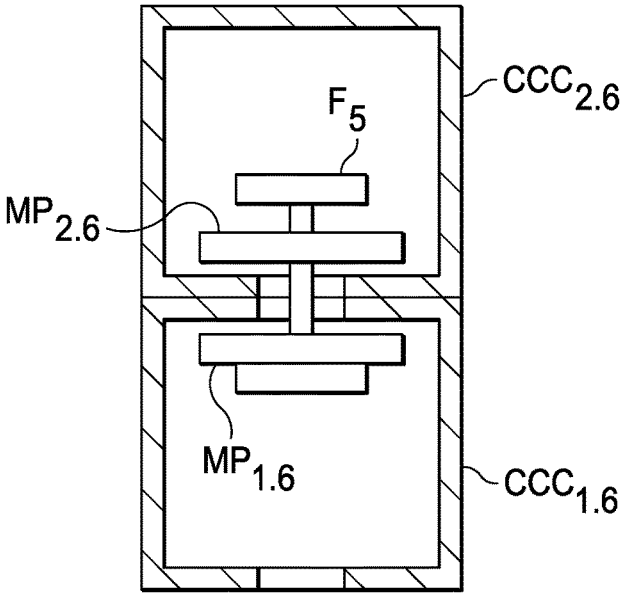

FIGS. 12A, 12B, and 12C illustrate a preferred embodiment structure for affixing Containers together when aligning Container vertical walls as shown in FIGS. 11A and 11B.

FIG. 12A illustrates a partial side view of the corrugated walls $WLC_{2.1}$ and $WLC_{2.6}$ and respective corner castings $CCC_{2.1}$ and $CCC_{2.6}$ of each of Containers $C_{2.1}$ and $C_{2.6}$ as Second Level Containers atop respective Containers $C_{1.1}$ and $C_{1.6}$ as First Level Containers below the Second Level Containers. Thus, each Container has a corner castings that abuts at least one casting corner of two other Containers. Moreover, further affixation is preferably achieved between abutting casting corners, as shown in FIGS. 12B and 12C.

FIG. 12B illustrates a cutaway top view of a respective casting corner of four different same level Containers, such as Containers $C_{2.6}$, $C_{2.7}$, $C_{2.1}$, and $C_{2.2}$ from FIG. 11B. In a preferred embodiment, angle iron is cut to a specified and desired length to fit within the interior of each casting corner, as shown at $AA_{2.6}$, $AA_{2.7}$, $AA_{2.1}$, and $AA_{2.2}$. Holes are formed in each such angle iron piece, where such holes align with respective holes that are known to exist in the casting corners, and a respective fastener $F_1$, $F_2$, $F_3$, or $F_4$ (e.g., nut and bolt) is positioned from an interior side of one angle iron, through two respective casting corner holes, through to the interior side of another angle iron, and the fastener is then tightened so as to provide a compressive force as between two respective casting corners. This is repeated for all four casting corners, thereby drawing each toward and in abutment with at least two other casting corners.

FIG. 12C illustrates a cutaway side view of a respective casting corner of two different same level Containers, such as Containers $C_{2.6}$ and $C_{2.1}$ from FIG. 11B. In a preferred embodiment, because all four same-level casting corners are coupled as shown in FIG. 12B, then preferably only one of those same level casting corners is coupled to a casting corner of the Container below it, thereby attaching up to either different Containers, four per each of two adjacent Levels, in a fixed relationship with respect to one another. To achieve such attachment in a preferred embodiment, a metal plate MP is cut to a specified and desired dimension to fit within the interior of each casting corner, as shown at $MP_{2.6}$ and $MP_{2.1}$. Holes are formed in each such metal plate, where such holes align with respective holes that are known to exist in the casting corners, and a single fastener $F_5$ (e.g., nut and bolt) is positioned from an interior side of one metal plate (e.g., $MP_{2.6}$) through a respective casting corner hole in each of two casting corners, through to the interior side of another metal plate (e.g., $MP_{1.6}$), and the fastener is then tightened so as to provide a compressive force as between two respective casting corners.

The preferred embodiments are therefore demonstrated above to have various apparatus, steps, and benefits, as will be appreciated by one skilled in the art. Further, while the inventive scope has been demonstrated by certain preferred embodiments, one skilled in the art will appreciate that it is further subject to various modifications, substitutions, or alterations, without departing from that inventive scope. For example, while certain apparatus and steps have been provided, alternatives may be selected. Thus, the inventive scope is demonstrated by the teachings herein and is further guided by the following exemplary but non-exhaustive claims.

What is claimed is:

1. A self-storage facility, comprising:

a first set of commercial containers aligned along, and forming, a first level of storage volume, the first set comprising a first commercial container and a second commercial container; and a second set of commercial containers, atop the first set and aligned along, and forming, a second level of storage volume, the second set comprising a third commercial container and a fourth commercial container;

wherein the third commercial container is positioned atop the first commercial container and the second commercial container by supporting:

a lower surface of a first lower corner casting of the third commercial container aligned to a first offset portion of an upper surface of a first upper corner casting of the first commercial container;

a lower surface of a second lower corner casting of the third commercial container aligned to a second offset portion of an upper surface of a second upper corner casting of the first commercial container;

a lower surface of a third lower corner casting of the third commercial container aligned to a third offset portion of an upper surface of a first upper corner casting of the second commercial container;

a lower surface of a fourth lower corner casting of the third commercial container aligned to a fourth offset portion of an upper surface of a second upper corner casting of the second commercial container;

a lower surface of a first lower corner casting of the fourth commercial container aligned to a fifth offset portion of the upper surface of the first upper corner casting of the second commercial container; and a lower surface of a second lower corner casting of the fourth commercial container aligned to a sixth offset portion of the upper surface of the second upper corner casting of the second commercial container.

2. The facility of claim 1:

wherein each corner casting has a width W; and;

wherein each of the first, second, third, and fourth offset portions is approximately W/2.

3. The facility of claim 2 wherein together each of the first, second, third, and fourth offset portions position the third commercial container atop the first commercial container and the second commercial container with a passage between the first commercial container and the second commercial container.

4. The facility of claim 3 wherein a distance across the passage and between the first commercial container and the second commercial container is approximately equal to a distance between opposing walls of the third commercial container.

5. The facility of claim 1 wherein together each of the first, second, third, and fourth offset portions position the third commercial container atop the first commercial container and the second commercial container with a passage between the first commercial container and the second commercial container.

6. The facility of claim 1:

wherein each of the first commercial container and the third commercial container has a major axis; and wherein the major axis of the third commercial container is shifted laterally in a vertical dimension with respect to the major axis of the first commercial container.

7. The facility of claim 1:

wherein each of the first, second, and third commercial container has a major axis; and wherein the major axis of the first, second, and third commercial container are parallel to one another.

8. The facility of claim 1 and further comprising an outer wall surrounding the first and second sets of commercial containers.

9. The facility of claim 1 wherein each commercial container in the first set and the second set has an access aperture located at an end or along a sidewall of the commercial container.

10. The facility of claim 1 wherein no commercial container is positioned on the first level between the first commercial container and the second commercial container.

11. The facility of claim 1 wherein the second set of commercial containers comprises a plurality of commercial containers.

12. The facility of claim 11:

wherein a selected commercial container, in the second set of commercial containers, has a first access aperture and a second access aperture located along a sidewall of the selected commercial container;

wherein the selected commercial container comprises a partition wall to partition an interior of the selected commercial container into plural storage volumes; and further comprising a walkway, external from the selected commercial container, providing a walking path between the first access aperture and the second access aperture.

13. The facility of claim 1 wherein the second set comprises plural commercial containers, and further comprising a third set of commercial containers, atop the second set, forming a third level of storage volume.

14. The facility of claim 13, wherein lower corner castings of at least one commercial container in the third set is supported by, and aligned to only offset portions of, upper corner castings of at least two containers in the second set.

15. The facility of claim 1 having an outer perimeter surrounding an area, and further comprising a majority of the area occupied with internal commercial containers, wherein each of the internal commercial containers has a major axis parallel to a respective major axis of other of the internal commercial containers.

16. The facility of claim 1 and further comprising a partition wall positioned in at least one of the commercial containers to partition an interior of the at least one of the commercial containers into plural storage volumes, wherein each of the plural storage volumes comprises an exposed corrugated wall facing an interior of the storage volume.

* * * * *